US006289859B1

(12) United States Patent
Fujii et al.

(10) Patent No.: US 6,289,859 B1
(45) Date of Patent: Sep. 18, 2001

(54) V-SHAPED INTERNAL COMBUSTION ENGINE

(75) Inventors: Noriaki Fujii; Kouta Yoshiura, both of Saitama (JP)

(73) Assignee: Honda Giken Kogyo Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/443,436

(22) Filed: Nov. 19, 1999

(30) Foreign Application Priority Data

Nov. 27, 1998 (JP) ..... 10-338168
Dec. 10, 1998 (JP) ..... 10-351501

(51) Int. Cl.[7] ..... F01L 1/34

(52) U.S. Cl. ..... 123/90.15; 123/90.12; 123/90.16; 123/90.17; 251/30.01; 251/33; 137/119.03; 137/119.04

(58) Field of Search ..... 123/90.15, 90.16, 123/90.17, 90.18, 90.33, 90.12; 251/30.01, 33; 137/119.03, 119.04

(56) References Cited

U.S. PATENT DOCUMENTS 6,155,218 * 12/2000 Line ..... 123/90.15

FOREIGN PATENT DOCUMENTS

3509094-A1 * 10/1985 (DE) ..... 123/90.15
406159105 * 6/1994 (JP) ..... 123/90.17
406212918 * 8/1994 (JP) ..... 123/90.17

* cited by examiner

*Primary Examiner*—Thomas Denion
*Assistant Examiner*—Jaime Corrigan
(74) *Attorney, Agent, or Firm*—Armstrong, Westerman, Hattori, McLeland & Naughton, LLP

(57) ABSTRACT

A V-shaped internal combustion engine in which banks of cylinders are V-shaped relative to each other and in which an intake manifold 40 is disposed between the V-shaped banks of cylinders, wherein a hydraulic pressure control valve 50 for controlling hydraulic pressures that are supplied to a hydraulic pressure control device is disposed at an end of a cylinder block 4 in a direction of a crankshaft between the V-shaped banks of cylinders.

12 Claims, 11 Drawing Sheets

V-SHAPED INTERNAL COMBUSTION ENGINE

BACKGROUND OF THE INVENTION

The present invention relates to a structure of a V-shaped internal combustion engine comprising a hydraulic pressure control device with respect to the disposition of a hydraulic pressure control valve.

In addition, the present invention also relates to a spool valve body structure comprising a hydraulic pressure controlling spool valve, and more particularly to a spool valve body structure adapted to be mounted on an internal combustion engine which comprises a hydraulic pressure controlling spool valve for controlling the supply of oil introduced under a predetermined hydraulic pressure to required portions via a spool valve.

In the case of a V-shaped internal combustion engine in which banks of cylinders are V-shaped relative to each other, it is the common practice to utilize a space between the V-shaped banks of cylinders for disposition of an intake manifold.

Japanese Unexamined Patent Publication No. Hei. 5-71315 discloses a V-shaped internal combustion engine comprising a variable valve timing control device in which a hydraulic pressure control valve is provided on a cylinder block.

The hydraulic pressure control device in the disclosed patent is disposed substantially at the center of a cylinder block in a direction of a crankshaft between the V-shaped banks of cylinders in such a manner as to protrude therefrom, and an intake manifold is disposed above the hydraulic pressure control valve.

Therefore, the intake manifold has to be disposed so as to avoid any interference with the hydraulic pressure control valve disposed between the V-shaped banks of cylinders, and this results in an increase in the height of the intake manifold by a distance which the hydraulic pressure control valve protrudes from the cylinder block, leading to the enlargement of the internal combustion engine.

In addition, the hydraulic pressure control valve resides between the V-shaped banks of cylinders and is covered with the intake manifold thereabove, this making it difficult to service the hydraulic pressure control valve for maintenance.

On the other hand, an example of conventional spool valve body structures is shown in FIG. 11 which has formed therein a spool valve chamber in which a spool valve is slidably received and an oil introduction chamber communicating with the spool valve chamber via a communication passage. This spool valve body 131 is mounted at an end of a cylinder block in a direction of a crankshaft which block is located between banks of cylinders of a V-shaped internal combustion engine which are laid out in a V-shaped fashion or V-shaped and provided in a valve mechanism for opening and closing intake valves and exhaust valves of the internal combustion engine for use in a hydraulic pressure control device for controlling hydraulic pressures for a variable valve timing switching mechanism for varying actuation timings and lift distances of the valves in response to running conditions of the internal combustion engine (for instance the revolutions of the internal combustion engine).

In this conventional spool valve body structure, the spool valve chamber 132 is formed downwardly from an upper surface of the spool valve body 131 as a bottomed hole having a uniformly circular cross-section. In addition the oil introduction passage 133 is formed upwardly from a lower surface of the spool valve body 131 as a bottomed hole having an axis which is parallel with an axis of the spool valve chamber 132 and a circular cross-section. When mounting the spool valve body on the internal combustion engine, the oil introduction passage 131 is connected to a main gallery formed in the cylinder block of the engine, and oil sent under pressure by an oil pump is supplied into this oil introduction passage 133. Furthermore, a controlling hydraulic pressure passage 134 open to the oil introduction passage 133 is formed downwardly from the upper surface of the spool valve body 131.

On the other hand, three vertically spaced-away lateral holes 161, 162, 163 are formed as a hole as cast in a side 131*b* of the spool valve body 131. The depth of the upper and middle lateral holes 161, 162 reaches a portion slightly beyond the spool valve changer 132. Of these two holes the upper lateral hole 161 constitutes a relief opening for relieving oil in order to relieve a high pressure supplied to the variable valve timing switching mechanism. The middle lateral hole 162 constitutes a working hydraulic pressure supply opening 162 for actuating the variable valve timing switching mechanism. Furthermore, the working hydraulic pressure supply opening 162 and the controlling hydraulic pressure passage 134 are caused to communicate with each other via a first orifice 131*a*. The depth of the lower lateral hole 163 reaches a portion slightly beyond the oil introduction passage 133, and this lower lateral hole 163 is intended to constitute a communication passage 164 for establishing a communication between the spool valve chamber 132 and the oil introduction passage 133, an open portion thereof being closed with a plug.

The spool valve 136 is slidably received in the spool valve chamber 132. This spool valve 136 has three lands; an upper land 136*b;* a middle land 136*c;* and a lower land 136*d,* and formed in the spool valve chamber 132 are a first annular chamber 132*a* partitioned by the upper land 136*b* and the middle land 136*c* and a second annular chamber 132*b* partitioned by the middle land 136*c* and the lower land 136*d.* A hole 136*e* is formed in the spool valve 136 which is open at a lower end and has a ceiling portion at an upper end thereof. This hole 136*e* has a stepped portion such that a portion corresponding to the lower land 136*d* constitutes a large-diameter portion and the remaining portion constitutes a small-diameter portion. A spring 137 is provided in the large-diameter portion of the hole 136*e* between the bottom of the spool valve chamber 132 and the stepped portion for biassing the spool valve upwardly. In addition, a second orifice 136*a* is formed in the ceiling portion which is open to the upper surface of the spool valve 136. Furthermore, the first annular chamber 132*a* is caused to communicate with the hole 136*e* via a communication passage 136*f.*

When a high hydraulic pressure is not applied to the upper surface of the spool valve 136, the spool valve 136 is situated at an upper position shown in FIG. 11-B by virtue of the biassing force of the spring 137, and therefore the communication passage 164 is closed by the lower land 136*b,* the first orifice 131*a* is caused to communicate with the second annular chamber 132*b,* the relief opening 161 is caused to communicate with the first and second annular chambers 132*a,* 132*b,* and the working hydraulic pressure supply opening 162 is caused to communicate with the second annular chamber 132*b.* On the other hand, when a high hydraulic pressure is applied to the upper surface of the spool valve 136, the spool valve is moved to a lower position against the biassing force of the spring 137, and in this state, the communication passage 164 and first orifice 131*a* are caused to communicate with the second annular chamber 132*b,* the relief opening 161 is caused to communicate only with the first annular chamber 132*a,* and the working hydraulic pressure supply opening 162 is caused to communicate with the second annular chamber 132*b.*

An electromagnetic valve body 150 is mounted on the upper surface of the spool valve body 131. Formed in this electromagnetic valve body 150 are an inlet passage 152 communicating with the controlling hydraulic pressure passage 134 and an outlet passage 153 communicating with the open end of the spool valve chamber 132 of the spool valve body 131 for supplying hydraulic pressures for application to the upper surface of the spool valve 136. When excited, a valve body 154 of the electromagnetic valve 151 is constructed to be separated from a valve seat therefor so as to establish a communication between the inlet passage 152 and the outlet passage 153, while when de-excited, the valve body 154 is constructed to be seated on the valve seat by a return spring so as to cut off the outlet passage 153 from the inlet passage 152.

A connecting member (not shown) is mounted on a side 131*b* of the spool valve body by making use of a mounting hole 131*c* and attached to this connecting member are a pipe communicating with the relief opening 161 and adapted to discharge relief oil and a pipe communicating with the working hydraulic pressure supply opening 162 and connected to the a working hydraulic pressure supply passage for supplying hydraulic pressures to the variable valve timing switching mechanism.

Next, an operation of the spool valve 136 in the spool valve body structure constructed as described above and a flow of oil therethrough will be described. Oil from the main gallery in the cylinder block not shown is supplied to the oil introduction passage 133 and the controlling hydraulic pressure passage 134. With the electromagnetic valve 151 being de-excited and the inlet passage 152 being closed by the valve body 154, since there is applied no high hydraulic pressure to the upper surface of the spool valve 136, the spool valve 136 is located at the upper position by virtue of the spring force of the spring 137. This causes the lower land 136*d* to close the communication passage 164, and the oil introduction passage 133 is caused to communicate with the second annular chamber 132*b* via the controlled hydraulic pressure chamber 134 and the first orifice 131*a*. On the other hand, the working hydraulic pressure supply opening 162 is caused to communicate with the second annular chamber 132*b,* and the relief opening 161 is caused to communicate with the outlet passage 153 via the first annular chamber 132*a,* a communication path 136*f,* the hole 136*e* and the second orifice 136*a,* and it is also caused to communicate with the working hydraulic pressure supply opening 162 via the second annular chamber 132*b.*

In this state, the high hydraulic pressure of the variable valve timing switching mechanism is relieved via the working hydraulic pressure supply passage 162, and the high hydraulic pressure in the outlet passage 153 is also relieved through the second orifice 136*a*. On the other hand, oil supplied from the first orifice 131*a* is supplied to the variable valve timing switching mechanism as a low hydraulic pressure via the working hydraulic pressure supply passage to thereby keep the variable valve timing switching mechanism in a non-operational state. Excess oil from the first orifice 131*a* is discharged via the relief opening 161 as relief oil.

Next, with the electromagnetic valve 151 being excited and the valve body 154 being separated from the valve seat to open the inlet passage 152, since the oil introduction passage 133 communicates with the outlet passage 153 via the controlling hydraulic pressure passage 134 and the inlet passage 152, the spool valve 136 is moved to the lower position against the biasing force of the spring 137 by virtue of the application of high hydraulic pressure in the oil introduction passage 133 to the upper surface of the spool valve 136. This causes the lower land 136*d* to move downwardly to open the communication passage 164, whereby the oil introduction passage 136 is caused to communicate with the second annular chamber 132*b* via the communication passage 164, while communicating with the first annular chamber 132*a* via the outlet passage 153, the second orifice 136*a,* the hole 136*e* and the communication path 136*f.*

In this state, a high hydraulic pressure is supplied to the working hydraulic pressure supply opening 162 via the communication passage 164, and this high hydraulic pressure is then supplied to the variable valve timing switching mechanism via the working hydraulic pressure supply passage to thereby actuate the same mechanism. On the other hand, a part of the oil in the outlet passage 153 is supplied to the relief opening 161 via the second orifice 136*a,* the hole 136*e,* the communication path 136*f* and the first annular chamber 132*a* and discharged as relief oil.

In the spool valve body structure as described above, there is no chance for the spool valve chamber 132 and the oil introduction passage 133 to overlap each other and they are formed with a bulkhead being interposed therebetween. Therefore, a distance between the axes of the spool valve chamber 132 and the oil introduction passage 133 becomes longer by a distance resulting from the existence of the bulkhead, this enlarging the spool valve body 131 accordingly. This causes a need to avoid an interference of the spool valve body 131 with an intake manifold disposed in line with an axial direction of a crankshaft between V-shaped banks of cylinders of the internal combustion engine. Thus, it was difficult to lay out the devices in a compact fashion.

In addition, the lateral holes are formed as a hole as cast which constitute the relief opening 161, the working hydraulic pressure supply opening 162 and the communication passage 164, and the depths of those lateral holes are deep enough to reach beyond the spool valve chamber 132. Due to this, it is inevitable that the gradient for forming such cored holes increases the opening areas of those openings and the passage in the spool valve body side 131*b,* and the sizes of portions corresponding thereto of the connecting member that is mounted on this side 131*b* of the spool valve body are eventually made larger than required functionally. As a result of this, the whole device constituting the oil passage system becomes larger and the spool valve body 131 itself also becomes large. Therefore, from this point it is hard to lay out the devices in a compact fashion.

Furthermore, in order to provide the communication passage 164, the lower lateral hole 163 needs to be formed as a hole as cast, and a plug also needs to be provided so as to close an open portion thereof. Due to this, not only is the spool valve body 131 made large but also man-hours are increased accordingly.

SUMMARY OF THE INVENTION

The present invention was made in view of the above disadvantage inherent in the prior art, and an object thereof is to provide a V-shaped internal combustion engine which can permit an intake manifold to be disposed low without an interference with a hydraulic pressure control valve to thereby make it possible to miniaturize the internal combustion engine and provide a superior serviceability for maintenance of the hydraulic pressure control valve.

The object above can also be achieved by a V-shaped internal combustion engine, according to a first aspect of the present invention, comprising:

a crankshaft;

a cylinder block including a plurality of cylinders which are banked about the crankshaft into a V-shape so as to form V-shaped banks relative to each other;

an intake manifold disposed between the V-shaped banks of the cylinders; and a hydraulic pressure control valve, disposed at one end of the cylinder block in an axial direction of the crankshaft and also disposed between the V-shaped banks of cylinders, for controlling hydraulic pressures which are supplied to a hydraulic pressure control device.

The object above can be attained by a V-shaped internal combustion engine, according to a second aspect of the present invention, in which banks of cylinders are V-shaped relative to each other and in which an intake manifold is disposed between the V-shaped banks of cylinders, wherein a hydraulic pressure control valve for controlling hydraulic pressures that are supplied to a hydraulic pressure control device is disposed at an end of a cylinder block in a direction of a crankshaft between the V-shaped banks of cylinders.

Since the hydraulic pressure control valve is disposed at an end of the cylinder block in the direction of the crankshaft between the V-shaped banks of cylinders, the intake manifold can be disposed so as to be installed between the V-shaped banks of cylinders without an interference with the hydraulic pressure control valve and this functions to keep the height of the intake manifold low, thereby making it possible to miniaturize the internal combustion engine.

Since the hydraulic pressure control valve resides at an end of the cylinder block in the direction of the crankshaft and is left exposed outside without being covered with the intake manifold, the hydraulic pressure control valve can easily be serviced for maintenance.

The object above can also be achieved by a V-shaped internal combustion engine, according to a third aspect of the present invention, in which banks of cylinders are V-shaped relative to each other and in which an intake manifold is disposed between the V-shaped banks of cylinders, wherein a hydraulic pressure control valve for controlling hydraulic pressures that are supplied to a variable valve timing control device is disposed at an end of a cylinder block in a direction of a crankshaft between the V-shaped banks of cylinders which end is opposite to the other end of the cylinder block where a timing mechanism is disposed, wherein an oil passage for supplying a hydraulic pressure to the variable valve timing control device in a cylinder head portion of each of the banks is disposed in the cylinder head portion, respectively, and wherein oil pass pipes connected to the oil passages at one end thereof, respectively, extend to a central portion in a transverse direction of the cylinder block to thereby be connected to the hydraulic pressure control valve at the other end thereof.

Since the hydraulic pressure control valve is disposed at an end of the cylinder block in the direction of the crankshaft between the V-shaped banks of cylinders which end is opposite to the other end of the cylinder block where the timing mechanism is disposed, the hydraulic pressure control valve can be disposed without interfering with the timing mechanism, and the intake manifold can be installed between the V-shaped banks of cylinders without interfering with the hydraulic pressure control valve, whereby the height of the intake manifold can be kept low, thereby making it possible to miniaturize the internal combustion engine.

Since the hydraulic pressure control valve resides at an end of the cylinder block in the direction of the crankshaft which end is opposite to the other end where the timing mechanism is disposed and is kept exposed outside without being covered with the intake manifold, it becomes easy to service the hydraulic pressure control valve for maintenance.

Since the oil pass pipes are used to supply oil to the oil passages in the cylinder head portions, the structure of the oil passage in the cylinder block can be prevented from being complicated and the length of the oil passage can be reduced, thereby making it possible to improve the response of the variable valve timing control device.

When referred to herein, the cylinder head portion means a part of the engine including a so-called cylinder head and rocker-arm shaft holders and camshaft holders provided thereon integrally or separately.

The hydraulic pressure control valve is disposed between the V-shaped banks of cylinders and supported at both sides thereof by the oil pass pipes, and therefore this construction is expected to be effective in prevention of vibrations.

The present invention was made to solve the aforesaid problems and an object thereof is to miniaturize the spool valve body. With a view to attaining the object, a fourth aspect of the present invention provides a spool valve body having formed therein a spool valve chamber having provided therein a sleeve in which a spool valve is slidably received and an oil introduction passage communicating with the spool valve chamber via a communication passage and having an axis parallel with an axis of the spool valve chamber, wherein the spool valve chamber and the oil introduction passage are formed so as to partially overlap each other when viewed in a direction of the axis of the spool valve chamber, and wherein the communication passage is formed in the sleeve.

According to a fourth aspect of the present invention constructed as described above, since the oil introduction passage partially overlaps the spool valve chamber, a distance between the axes of the spool valve chamber and the oil introduction passage can be made shorter than that of the prior art, thereby making it possible to miniaturize the spool valve body accordingly. Furthermore, since the mounting seat for the spool valve body can be made smaller to the extent that the spool valve body is miniaturized, devices surrounding the spool valve body can be disposed in a compact fashion in addition to the miniaturization of the spool valve body itself. Moreover, since the communication passage is formed in the sleeve, there is no need to provide in the spool valve body itself a hole constituting such a communication passage. This obviates the necessity of a member for closing an opening of a hole otherwise needing to be formed and work involved in closure of the opening, and the spool valve body can be miniaturized to the extent that the conventional hole is eliminated.

BRIEF DESCRIPTION OF THE DRAWINGS

FIG. 9 is a diagram explaining a flow of oil in the spool valve body shown in FIG. 8, and FIG. 9A shows a case where a low hydraulic pressure is supplied, while

DETAILED DESCRIPTION OF THE PREFERRED EMBODIMENTS

Figure 1:
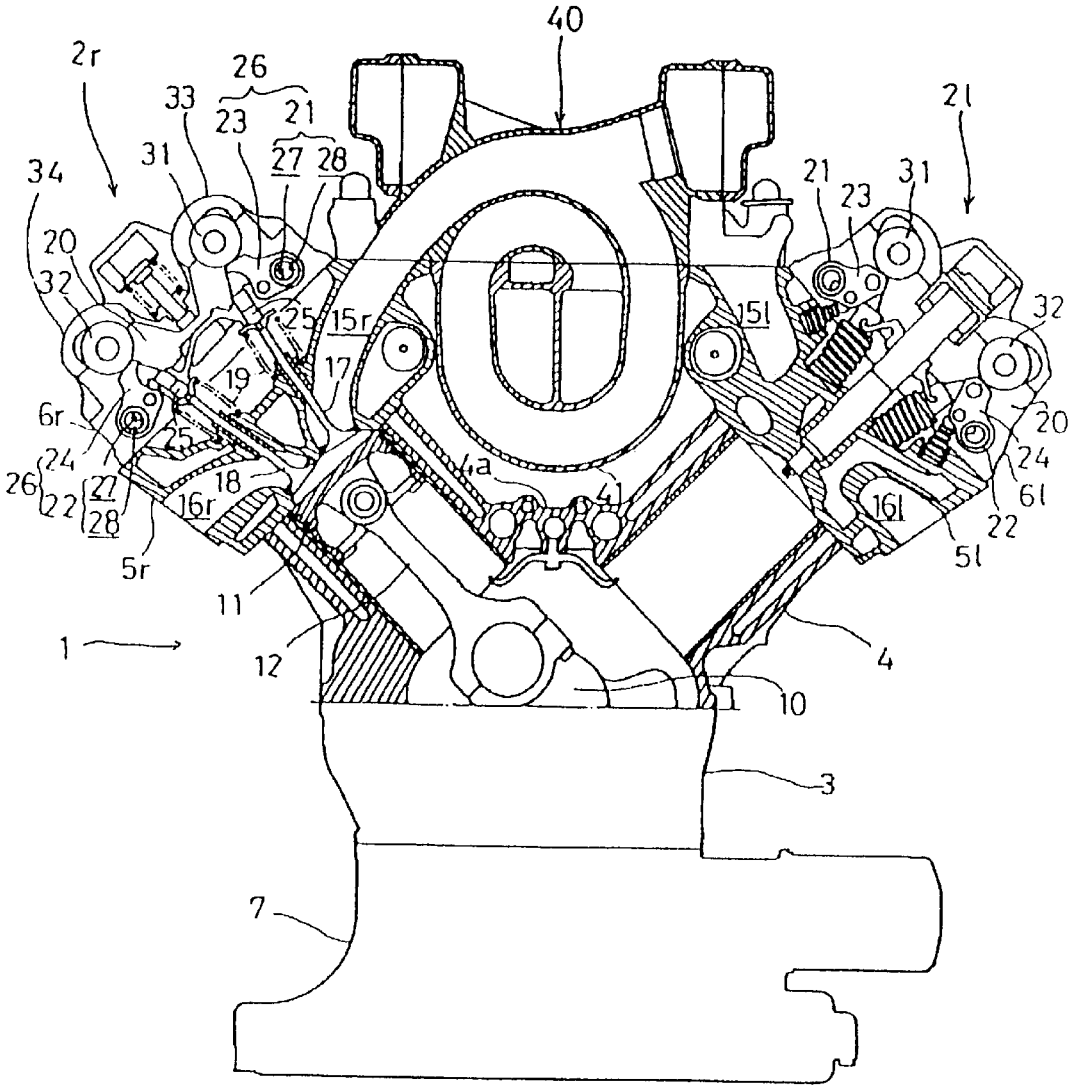
FIG. 1 is a vertically sectional front view of an internal combustion engine according to a mode of the present invention.
Figure 2:
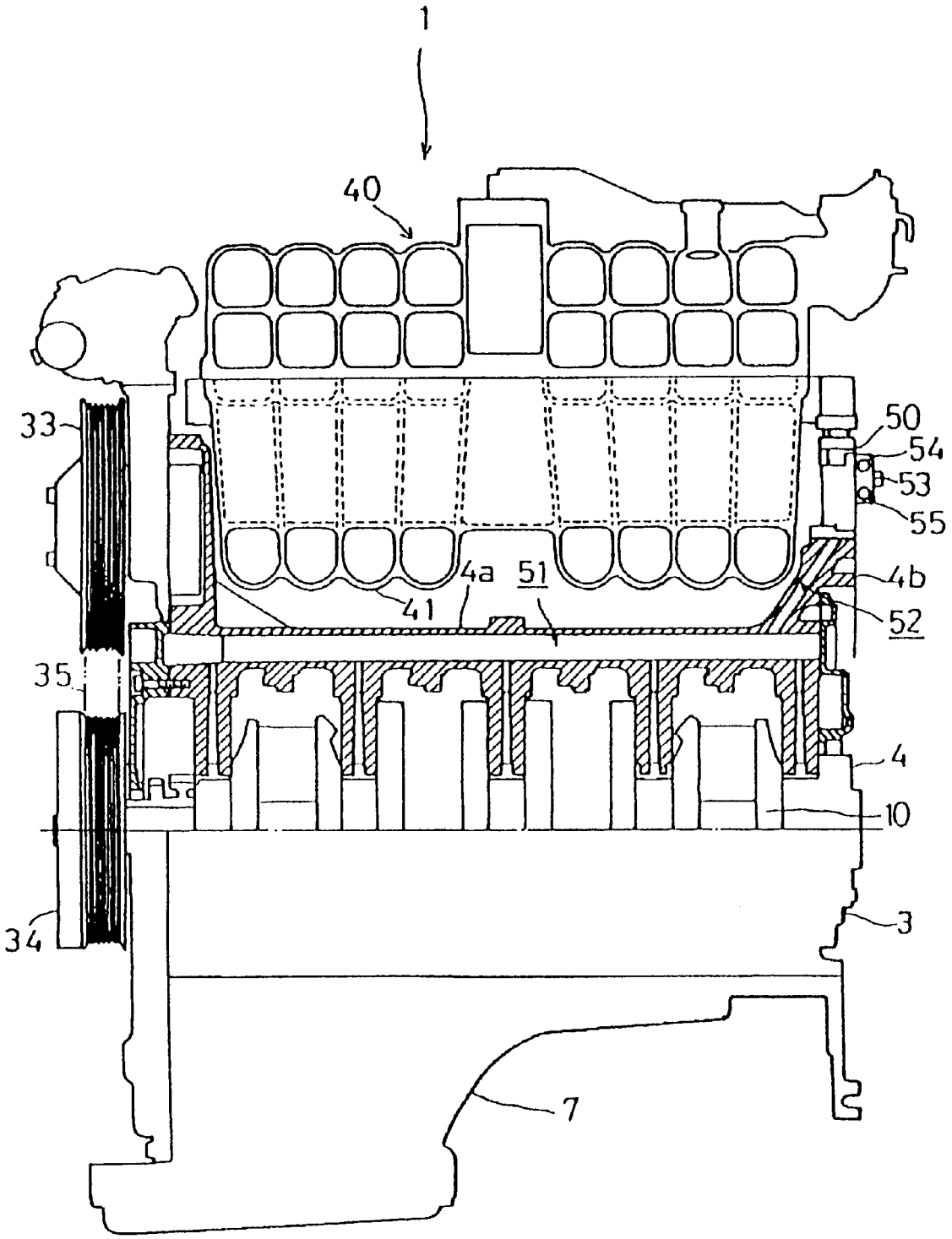
FIG. 2 is a longitudinally sectional side view of the same internal combustion engine.
Figure 3:
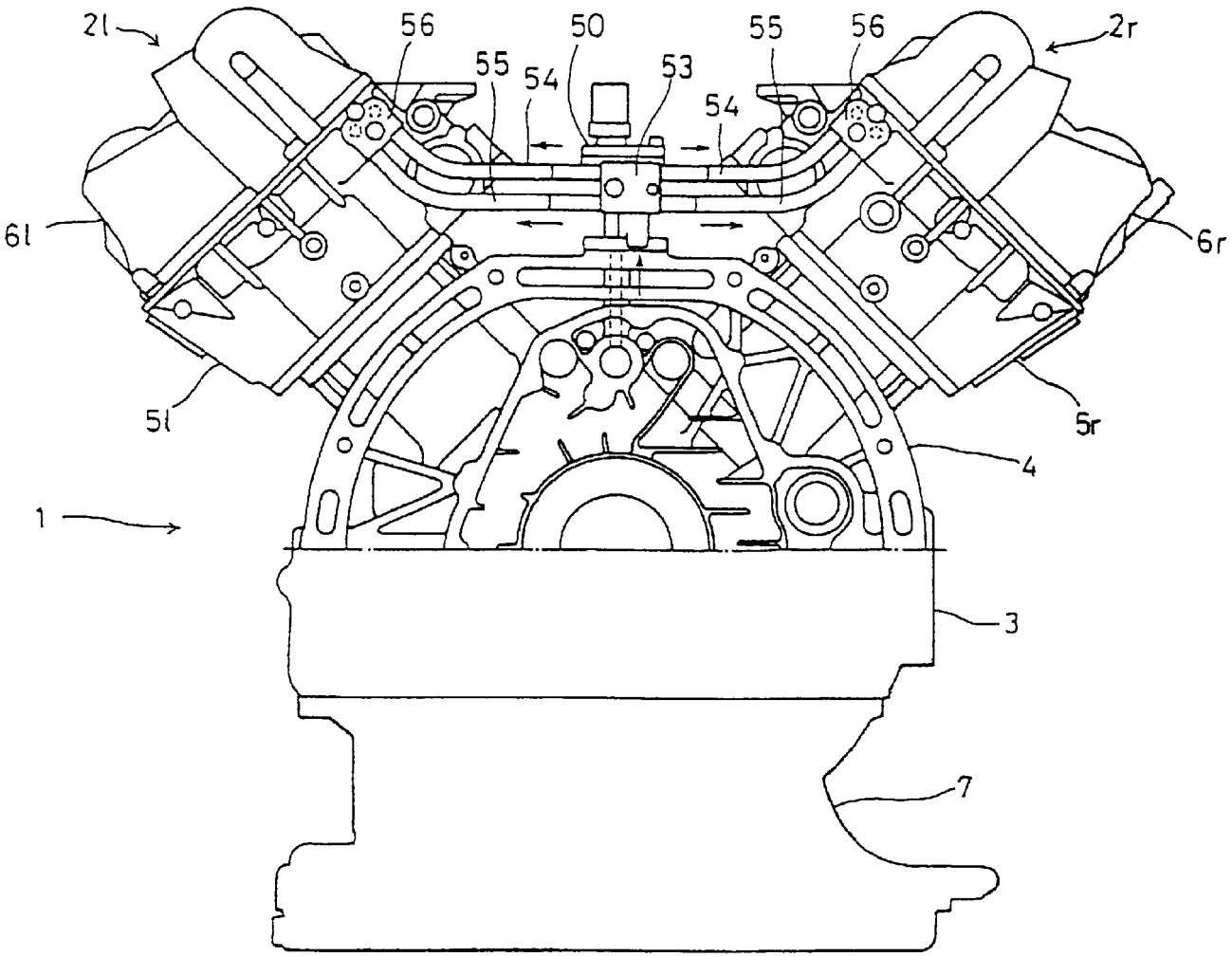
FIG. 3 is a rear end view of the same internal combustion engine.

Referring to FIGS. 1 to 4, a mode of operation of the present invention will be described below.

An internal combustion engine according to the mode of operation of the present invention is a V-shaped eight-cylinder internal combustion engine 1. This engine is installed longitudinally in a vehicle such that a crankshaft 10 is directed in a longitudinal direction and comprises left and right banks 2*l*, 2*r* of cylinders each comprising in turn four cylinders and disposed in a V-shaped fashion or V-shaped with respect to the crankshaft 10 when viewed from the front thereof.

A lower crank case 3 and an upper cylinder block 4, which are vertically separated with respect to the crankshaft 10, are integrated together, and the cylinder block 4 is constituted by the left and right banks of cylinders each comprising four cylinders and V-shaped relative to each other.

Cylinder heads 5*l*, 5*r* are overlaid on the top of the left and right banks of cylinders of the cylinder block 4 and cylinder covers 6*l*, 6*r* are then overlaid on the cylinder heads 5*l*, 5*r*, and they are integrally secured to each other.

In addition, an oil pan 7 is mounted underneath the crank case 3.

A connecting rod 12 connects a piston 11 in each of the cylinders in the cylinder block 4 with a crank pin of the crankshaft 10.

The left and right cylinder heads 5*l*, 5*r* each have a rocker arm-type DOHC valve mechanism, and intake ports 15*l*, 15*r* are disposed transversely inwardly of the banks of cylinders and exhaust ports 16*l*, 16*r* are disposed transversely outwardly thereof in the respective cylinder heads.

Intake valves 17 and exhaust valves 18 are biassed by means of valve springs 19, 19 such that they close intake valve ports and exhaust valve ports, respectively.

Intake rocker arms 23 and exhaust rocker arms are rockingly fitted, respectively, over intake rocker arm shafts 21 and exhaust rocker arm shafts 22 which penetrate and are supported by rocker arm shaft holders 20, 20 provided on the cylinder heads 5*l*, 5*r* in such a manner as to project therefrom, and the intake valves 17 and the exhaust valves 18 are caused to slide via hydraulic tappets 25, 25 each disposed at an end of a valve stem so as to open and close the intake valve ports and exhaust valve ports, respectively, by virtue of rocking of the intake rocker arms 23 and the exhaust rocker arms 24.

With respect to the intake rocker arms 23 and the exhaust rocker arms 24, there are provided two types of rocker arms, i.e., for high-speed and low-speed, and variable valve timing control devices 26 are provided therefor which are each controlled so as to switch valve timings for the respective speeds by virtue of hydraulic pressures.

Valve timing switching hydraulic pressure supply passages 27, 27 are formed in the intake rocker arm shaft 21 and exhaust rocker arm shaft 22, respectively and valve timings can be switched over by virtue of hydraulic pressures supplied into the valve timing switching hydraulic pressure supply passages 27, 27.

These intake rocker arm shaft 21 and exhaust rocker arm shaft 22 are a so-called two-hole rocker arm shaft, and lubricant passages 28, 28 are formed therein on top of the aforesaid valve timing switching hydraulic pressure supply passages 27, 27. These lubricant passages 28, 28 are a passage intended to supply oil to cam dowels, the intake rocker arms 23, the exhaust rocker arms 24 or the like for lubrication thereof.

An intake camshaft 31 and an exhaust camshaft 32 for driving the intake rocker arms 23 and the exhaust rocker arms 24, respectively, are rotatably held above the intake rocker arm shaft 21 and the exhaust rocker arm shaft 22 by the rocker arm shaft holder 20, an intake camshaft holder 33 and an exhaust camshaft holder 34.

An intake manifold 40 is disposed in a V-shaped space formed between the left and right banks 2*l*, 2*r* of cylinders and spiral intake pipes 41 of the intake manifold 40 are connected to the intake ports 15*l*, 15*r*.

The spiral intake pipes 41 penetrate deep into the V-shaped space defined at the bottom by an upper wall 4*a* of the cylinder block 4 residing at the center thereof which acts as a bottom wall of the space to such an extent that they become close to the upper wall 4*a* for installation thereat, whereby the intake manifold 40 is disposed thereat such that the height thereof is kept low as a whole.

At a front of the V-shaped eight-cylinder internal combustion engine 1 cam pulleys 33, 33 are securely fitted on intake camshafts 31 and exhaust camshafts 32 at front ends thereof, and a timing belt 35 is provided to extend between a drive pulley 34 securely fitted on a front end of the crankshaft and the cam pulleys 33, 33, whereby the rotation of the crankshaft 10 is transmitted to the intake camshafts 31 and the exhaust camshafts 32 via the timing belt 35 for rotation thereof.

At a rear of the V-shaped eight-cylinder internal combustion engine 1 which is opposite to the end of the engine where the aforesaid timing mechanism is provided a rear end wall 4*b* is formed at a recessed central portion between the left and right V-shaped banks of cylinders of the cylinder block 4 so as to rise slightly therefrom, and a vertical spool valve 50 is secured to the rear end wall 4*b* so as to project upwardly therefrom.

A block main gallery 51 is formed in the transversely central upper wall portion 4*a* in such a manner as to be directed in the crankshaft direction, and a communication passage 52 formed diagonally from a rear end of the block main gallery 51 through the rear end wall 4*b* is connected to a hydraulic pressure supply port of the spool valve 50.

A connecting member 53 is integrally secured to a rear side of the spool valve 50, and two upper and lower parallel oil pass pipes 54, 55 extend transversely from left and right sides of the connecting member 53, respectively.

Being provided as described above, there is no risk of the oil pass pipes interfering with the intake manifold.

The spool valve 50 has a valve timing switching hydraulic pressure outlet and a relief oil outlet, and the connecting member 53 distributes oil from the respective outlets in left and right directions so as to make it flow into the oil pass pipes 54, 55.

On the other hand, connecting members 56 are integrally secured to a rear side of the left and right cylinder heads 5*l*, 5*r* on the intake port side, respectively, and the two oil pass pipes 54, 55 extending transversely in left and right directions from the spool valve 50 are connected to the left and right connecting members 56, 56 at the other end thereof, respectively.

Figure 4:
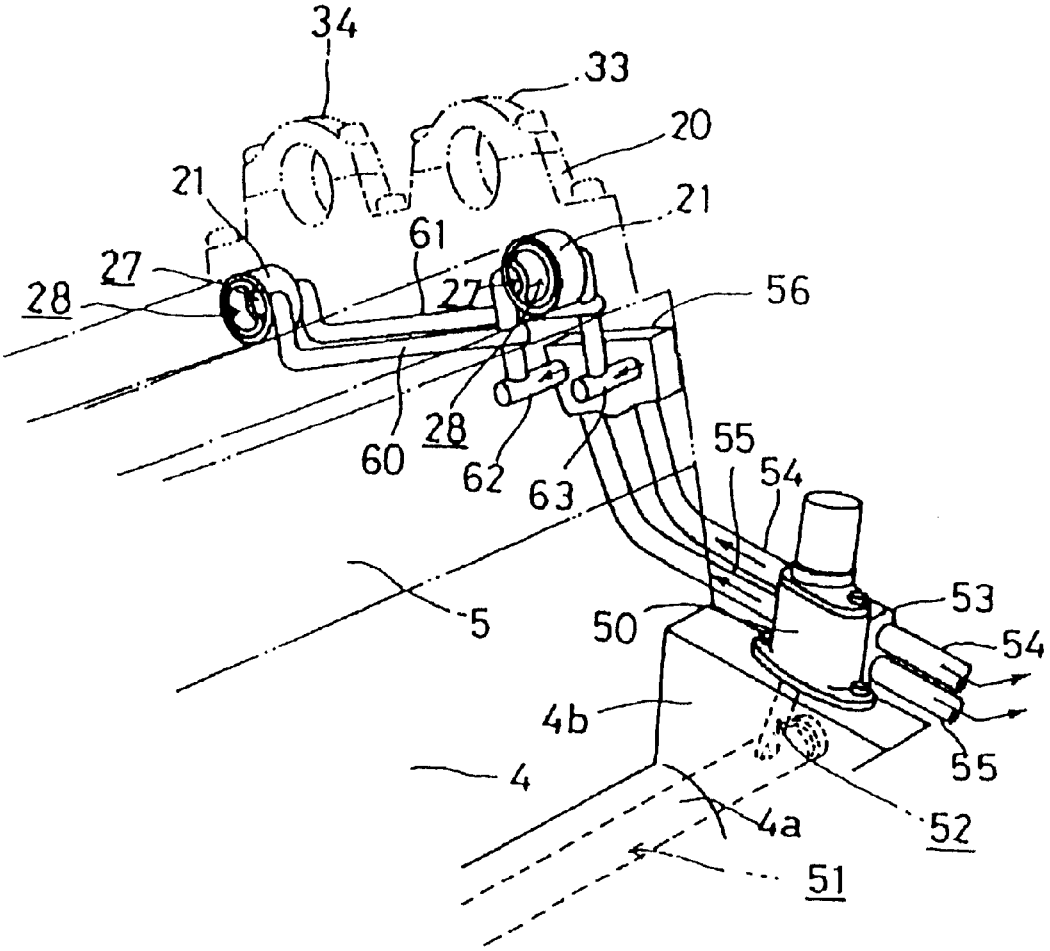
FIG. 4 is a partially see-through perspective view showing a main part of the same internal combustion engine.

As shown in FIG. 4, formed in the cylinder head 5*l*, 5*r* and the rocker arm shaft holder 20 supporting the intake rocker arm shaft 21 and the exhaust rocker arm shaft 22 are a valve timing switching hydraulic pressure communication passage 60 for establishing a communication between the valve timing switching hydraulic pressure supply passages 27 formed in the intake rocker arm shaft 21 and exhaust rocker arm shaft 22 and a lubricant communication passage 61 for establishing a communication between the lubricant passages 28 also formed in the respective rocker arm shafts. In addition, communication passages 62, 63 are provided so as extend from the intake rocker arm shaft 21 side of the valve timing hydraulic pressure communication passage 60 and lubricant communication passage 61 to the aforesaid connecting members 56, respectively.

Consequently, a hydraulic pressure from the valve timing switching hydraulic pressure outlet is branched in left and right directions at the connecting member 53 and enters the left and right cylinder heads 5*l*, 5*r* and the communication passages 62, 62 in the rocker arm shaft holders 20 from the oil pass passages 54, 54 through the connecting members 56, 56. Then, the hydraulic pressure enters the valve timing switching hydraulic pressure passages 27, 27 in the intake rocker arm shafts 21, 21 and also enters the valve timing switching hydraulic pressure passages 27, 27 in the exhaust rocker arm shafts 22, 22 via the valve timing switching hydraulic pressure communication passages 60, 60, whereby the hydraulic pressure is eventually supplied to the respective valve timing control devices 26.

In addition, the spool valve 50 is adapted to switch over the hydraulic pressures between low and high pressures through driving of a solenoid so as to supply such hydraulic pressures to the valve timing control devices 26 to thereby switch over the valve timings accordingly.

Similarly, relief oil flowing from the relief oil outlet of the spool valve 50 is branched in the left and right directions at the connecting member 53 and enters the left and right cylinder heads 5*l*, 5*r* and the communication passages 63, 63 in the rocker arm shaft holders 20, 20 from the oil pass pipes 55, 55 through the connecting members 56, 56. The hydraulic pressure then enters the lubricant passages 28, 28 in the intake rocker arm shafts 21, 21 and also enters the lubricant passages 28, 28 in the exhaust rocker arm shafts 22, 22 through the lubricant communication passages 61, 61 to thereby lubricate the cam dowels and rocker arms 23, 24, respectively.

The V-shaped eight-cylinder internal combustion engine 1 of the present invention is constructed as described heretofore, and since the spool valve 50 is provided at the rear end wall of the cylinder block 4 between the left and right banks 2*l*, 2*r* of cylinders in such a manner as to erect therefrom, the intake manifold 40 can penetrate into the space between the left and right banks 2*l*, 2*r* of cylinders to the extent that it approximates the upper wall 4*a* at the transverse center of the cylinder block at the lower end thereof without interfering with the spool valve 50, so that the intake manifold 40 can be installed between the V-shaped banks of cylinders, whereby the height of the intake manifold can be kept low, thereby making it possible to miniaturize the internal combustion engine 1.

In addition, the spool valve 50 is disposed at the rear end of the cylinder block 4 which is opposite to the front end thereof where the timing mechanism such as the timing belt 35 is disposed and hence it is kept not interfering with the timing mechanism. Furthermore, the timing mechanism and the spool valve 50 can be disposed at the front and rear ends of the cylinder block 4 in such a manner that they do not protrude largely upwardly from the cylinder block 4. Thus, the enlargement of the internal combustion engine 1 can be prevented.

Since the spool valve 50 is provided at the rear end wall 4*b* of the cylinder block 4 in such a manner as to erect therefrom and is kept exposed without being covered with the intake manifold 40, the spool valve 50 can easily be serviced for maintenance.

Since the externally mounted oil pass pipes 54, 54 are used to supply from the spool valve 50 hydraulic pressures to the valve timing switching hydraulic pressure passages 27, 27 in the cylinder heads 5*l*, 5*r*, the oil passage structure inside the cylinder block 4 can be simplified and a short oil passage can be set without being regulated by the configuration of the cylinder block 4, whereby the oil transmission speed can be increased to thereby improve the response of the variable valve timing control devices 26.

Since the connecting member 53 secured to the spool valve provided at the central rear end wall 4*b* of the cylinder block 43 and the connecting members 56 secured to the rear sides of the rear end rocker arm shaft holders 20 at the rear ends of the left and right cylinder blocks 51, 5*r* are connected to each other by means of the oil pass pipes 54, 55, the length of the oil pass pipes 54, 55 provided along the rear end surface of the cylinder blocks 2 can be short.

Since the spool valve 50 is constructed such that it is provided at the rear end wall 4*b* of the cylinder block 4 in such a manner as to erect therefrom and is supported at both sides thereof by two parallel oil pass pipes 54, 55, the spool valve 50 can be restrained from being vibrated.

In addition, since the oil pass pipes 54, 55 bend in parallel with each other to connect the connecting member 53 with the respective connecting members 56, a thermal expansion can be absorbed thereby.

According to the mode of the operation of the present invention, since the two oil pass pipes 54, 55 extend in the left and right directions from the spool valve 50, even if the number of valve timing switching hydraulic pressure supply passages increases as the number of switching modes for valve timings increases, it can easily be dealt with by increasing the number of oil pass pipes accordingly, and complication and enlargement of the oil passage structure in the cylinder block can be avoided.

As is described in the mode of operation of the present invention, the oil pass pipes can be used to supply hydraulic pressures for switching over the valve timings and it can also be applied to lubricate the valve system as well as supplying oil to the hydraulic tappets.

Referring to FIGS. 5 to 10, a mode of operation of the present invention will be described. During the description, like reference numerals are given to constituent members like to those used in the above-described prior art example, and repeated descriptions thereof will be omitted herein.

Figure 8B:
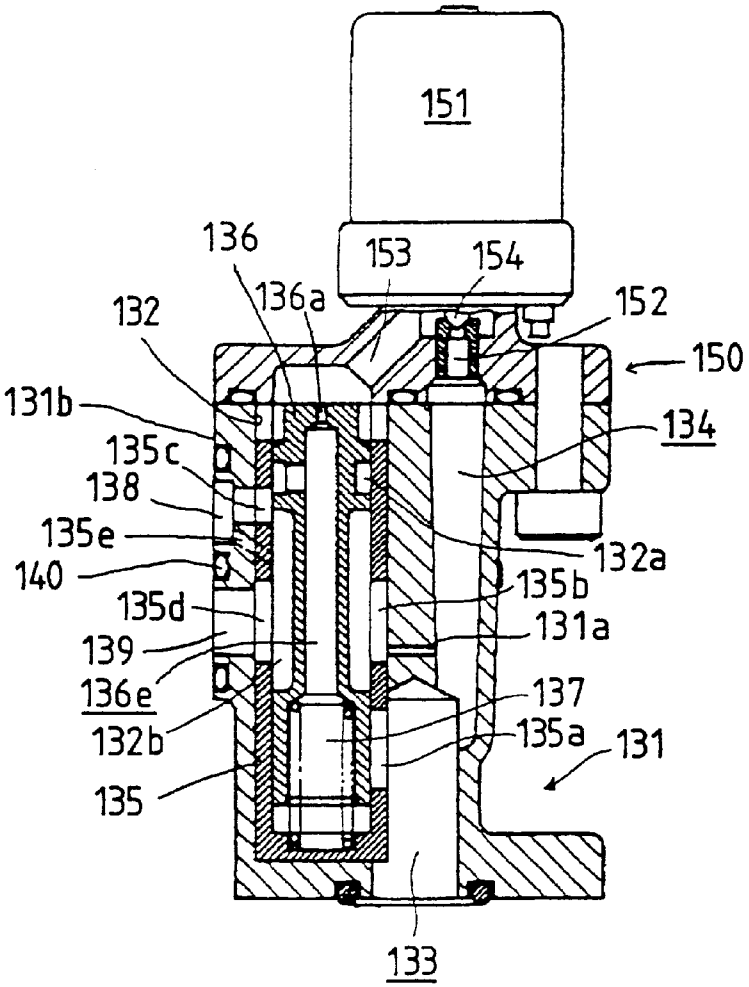
FIG. 8 is a front view of the spool valve body according to the mode of operation of the invention of the present patent application, and B is a vertical sectional-view of the same.
Figure 8A:
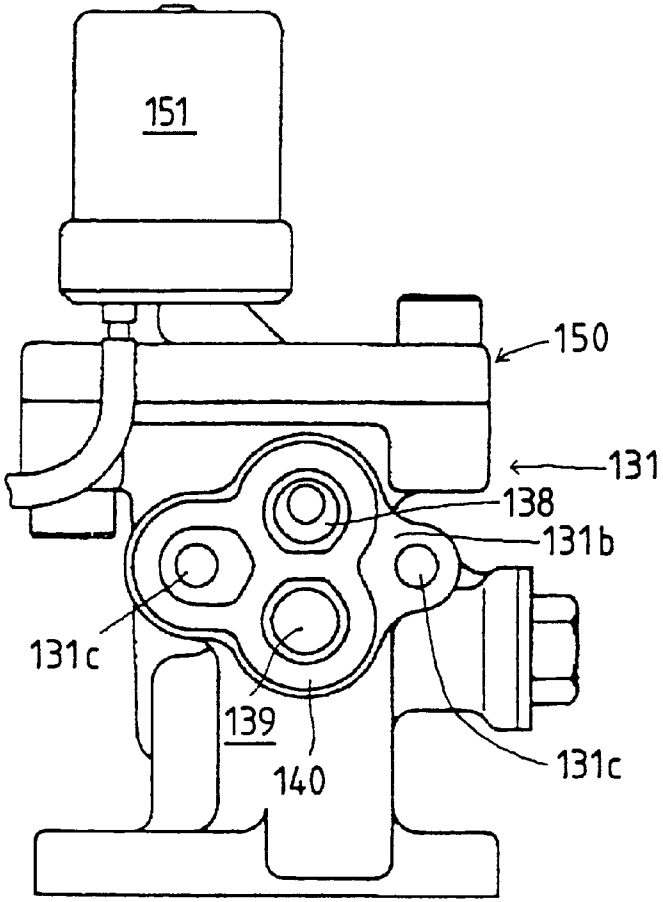

A spool valve body 131 shown in FIG. 8 as having a valve body structure according to the mode of operation of the present invention is intended to be disposed at an end of a cylinder block in an axial direction of a crankshaft between V-shaped banks of cylinders of a V-shaped internal combustion engine. Hereinafter, an example will be described in which the above spool valve body 131 is used as the spool valve body that is mounted on the V-shaped internal combustion engine described in the first embodiment.

Figure 5:
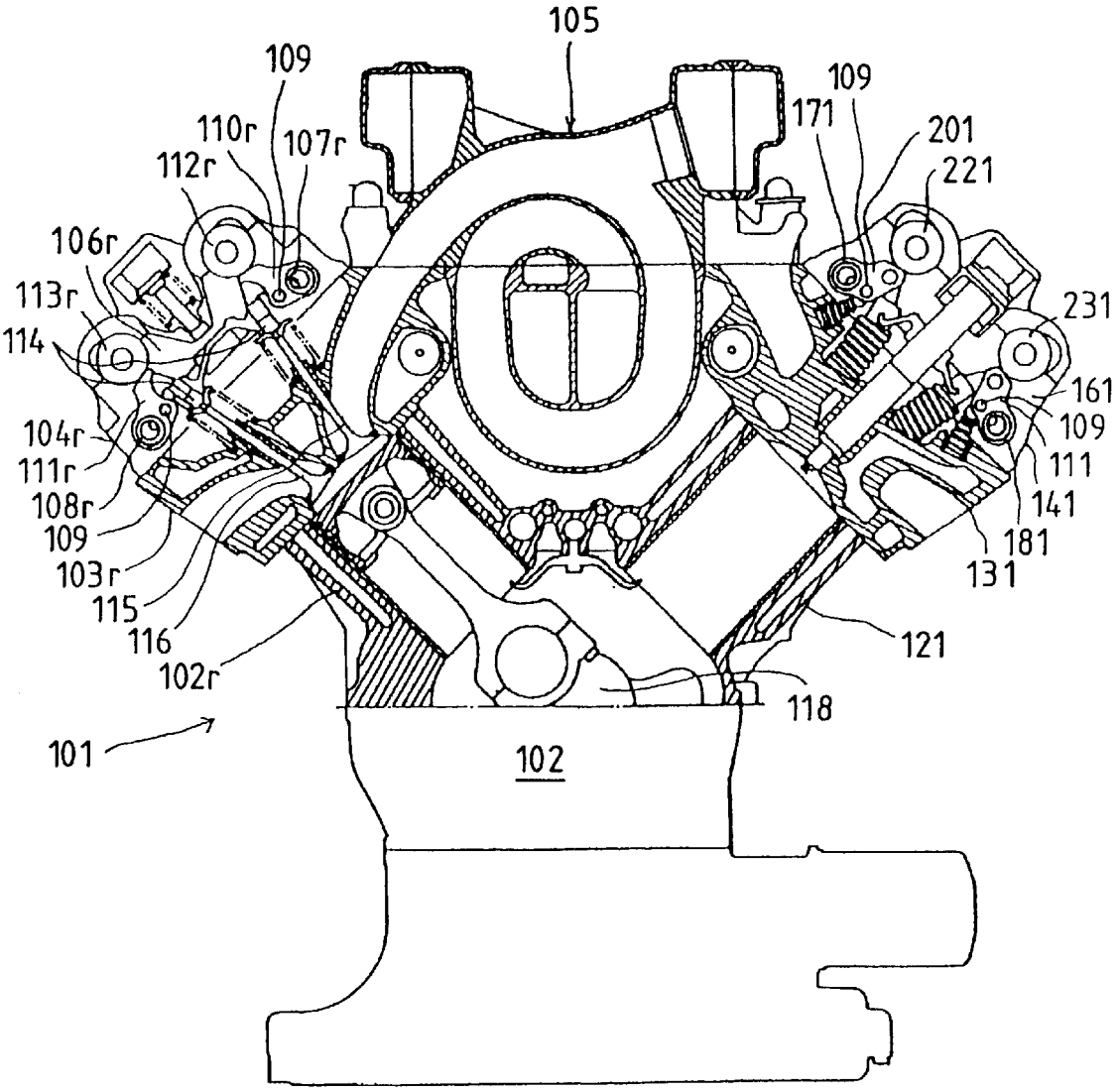
FIG. 5 is a front vertical sectional view of a V-shaped internal combustion engine to which a spool valve body according to a mode of operation of the invention of the present patent application is applied.
Figure 6:
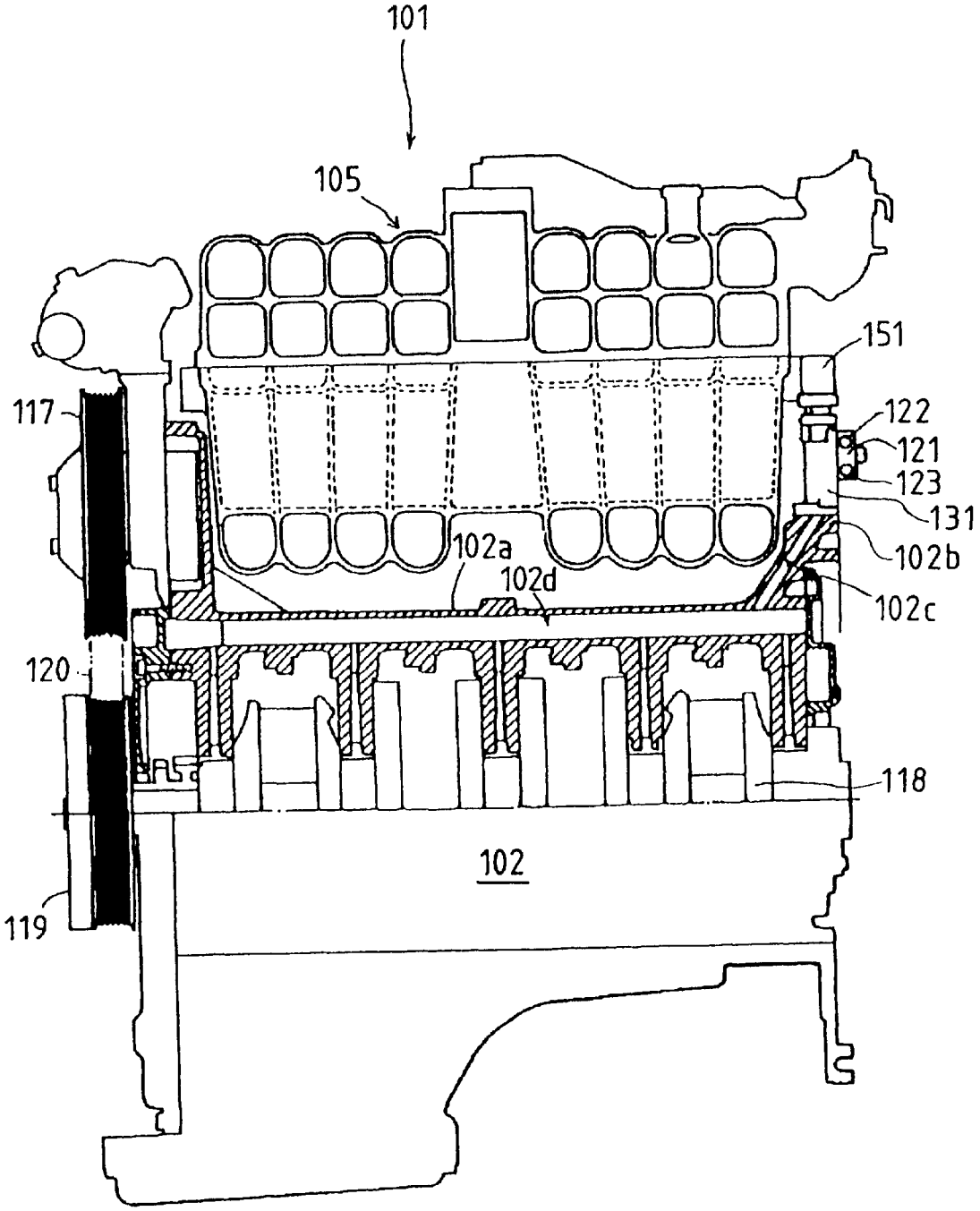
FIG. 6 is a side vertical sectional view of the same V-shaped internal combustion engine.

As shown in FIGS. 5 and 6, this V-shaped internal combustion engine is a V-shaped eight-cylinder internal combustion engine 100, and the same engine is installed longitudinally in a vehicle. Left and right banks 102*r*, 102*l* of a cylinder block 102 each comprise four cylinders, and cylinder heads 103*r*, 103*l* and cylinder head covers 104*r*, 104*l* are overlaid on the top of the respective banks 102*r*, 102*l* of cylinders in that order and are then integrally secured to each other. In addition, an intake manifold 105 in which spiral intake passages are formed therein is disposed between the left and right banks 102*r*, 102*l* of cylinders which are laid out or disposed in a V-shaped fashion (hereinafter, referred to as "V-shaped").

Valve mechanisms are mounted on the cylinder heads 103*r*, 103*l*, and intake rocker arms 110*r*, 110*l* and exhaust rocker arms 111*r*, 111*l* each comprising a variable valve timing mechanism 109 are rockingly supported on intake rocker arm shafts 107*r*, 107*l* and exhaust rocker arm shafts 108*r*, 108*l* supported in turn on holders 106*r*, 106*l* on the cylinder heads 103*r*, 103*l*. In addition, the intake rocker arms 110*r*, 110*l* and exhaust rocker arms 111*r*, 111*l* rocked by driven cams 144 (refer to FIG. 10) provided on rotating intake camshafts 112*r*, 112*l* and exhaust camshafts 113*r*, 113*l*, respectively, drive intake valves 115 and exhaust valves 116 via hydraulic tappets 114 to open and close the same valves.

As shown in FIG. 6, a timing mechanism is provided at a front of the V-shaped internal combustion engine 100 in which a timing belt 120 is extended between cam pulleys 117 securely fitted on the intake camshafts 112*r*, 112*l* and the exhaust camshafts 113*r*, 113*l* at front ends thereof and a drive pulley 119 securely fitted on a crankshaft 118 at a front end thereof, so that the rotation of the crankshaft 118 is constructed to be transmitted to the intake camshafts 112*r*, 112*l* and the exhaust camshafts 113*r*, 113*l* via the timing belt 120.

On the other hand, at a rear of the V-shaped internal combustion engine which is opposite to the end where the timing mechanism is provided a mounting seat 102*b* is formed at a rear end of a recessed transversely central upper wall 102*a* of the cylinder block 102 in the axial direction of the crankshaft 118 between the V-shaped banks of cylinders in such a manner as to rise therefrom. The spool valve body 131 having the valve body structure according to the mode of operation of the invention of the present patent application is mounted on this mounting seat 102*b*.

Figure 7:
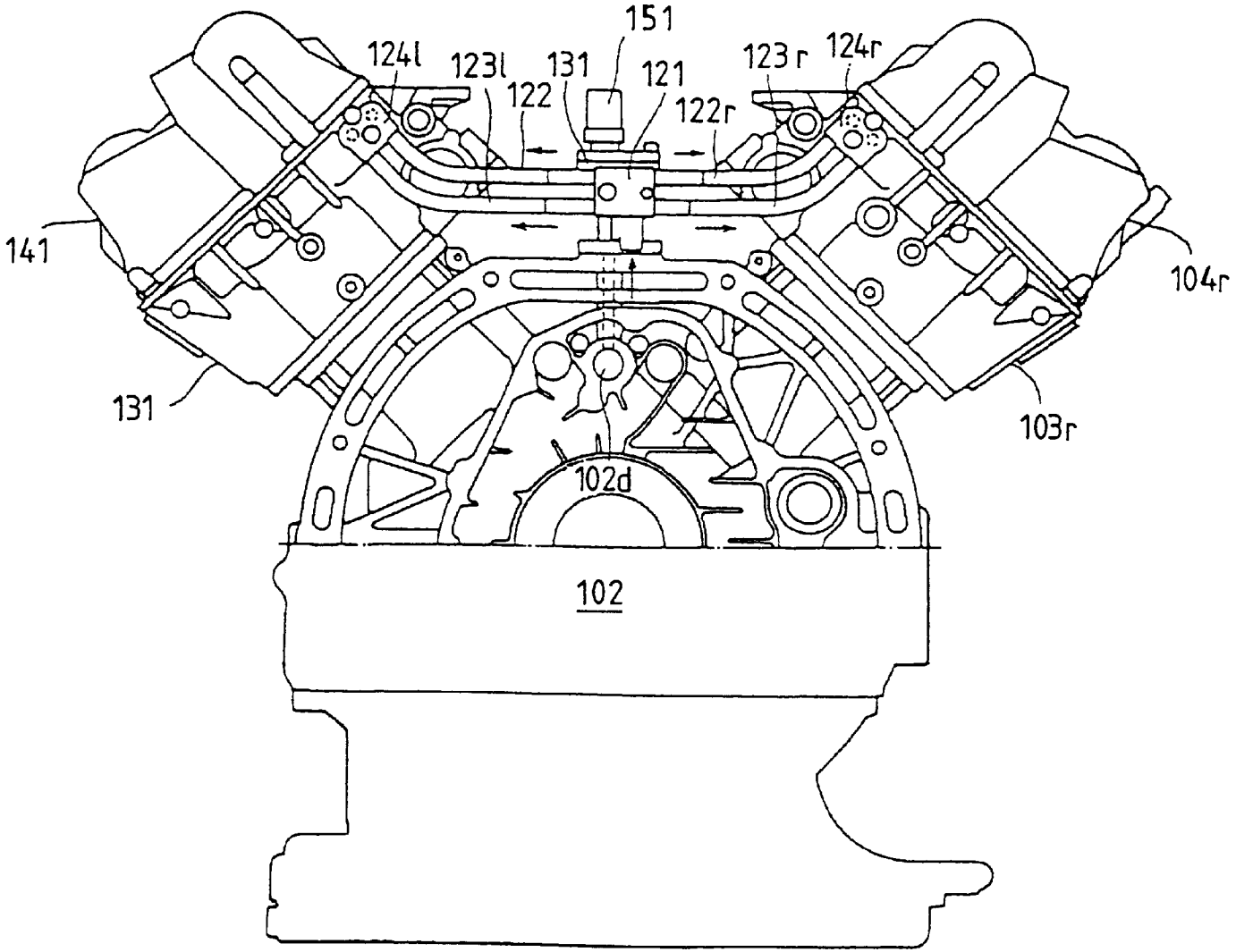
FIG. 7 is a rear view of the same V-shaped internal combustion engine.

A connecting member 121 is mounted on the spool valve body 131. As shown in FIG. 7, upper and lower two oil pass pipes 122*r*, 122*l*, 123*r*, 123*l* extending in parallel transversely or in left and right directions are connected to left and right sides of the connecting member 121 at one end thereof, respectively, and they are also connected at the other end thereof, respectively, to lower surfaces of connecting members 124*r*, 124*l* mounted on the intake sides of the cylinder heads 103*r*, 103*l*.

The spool valve body 131 will be described in detail below. As shown in FIG. 8, this spool valve body 131 is identical to that of the prior art in that a spool valve chamber 132 is formed in the spool valve body 131 from an upper surface thereof in such a manner as to be oriented downwardly as a bottomed hole having a uniformly circular cross-section, while an oil introduction passage 133 if formed from a lower surface of the spool valve body 131 in such a manner as to be oriented upwardly as a bottomed hole having an axis in parallel with an axis of the spool valve chamber 132 and a circular cross-section, but it is different from the prior art in that the oil introduction passage 133 is formed in such a manner as to partially overlap the spool valve chamber 132 when viewed from the axial direction of the spool valve chamber 132. In other words, the spool valve chamber 132 and the oil introduction passage 133 communicate with each other at side walls thereof when formed as described above. In addition, the oil introduction passage 133 is communicate with an oil gallery 102d formed in the cylinder block 102 of the V-shaped internal combustion engine 101 via an oil supply passage 2C.

A sleeve 135 is inserted into the spool valve chamber 132, and openings formed in this sleeve 135 cooperate with a spool valve 136 slidably received in the sleeve 135 to control the supply of hydraulic pressures. In addition, since the spool valve chamber 132 partially overlaps the oil introduction passage 133 when viewed in an axial direction thereof, the sleeve 135 partially protrudes into the oil introduction passage 133.

Next, the openings formed in the sleeve 35 will be described. A first opening 135*a* is formed in a position of the sleeve 135 facing the oil introduction passage 136, and this first opening 135*a* constitutes a communication passage 135*a* for establishing a communication between the spool valve chamber 132 and the oil introduction passage 133. In addition, a second opening 135*b* is formed in a position corresponding to the first orifice 131*a*. Furthermore, third and fourth openings 135*c*, 135*d* are formed in positions corresponding to a relief opening 138 and a working hydraulic pressure supply opening 39, respectively.

A side 131*b* of the spool valve body where the relief opening 138 and the working hydraulic pressure supply opening 139 is a plane in parallel with the axis of the spool valve chamber 132. The relief opening 38 and the working hydraulic pressure supply passage 139 are formed such that axes thereof intersect with the axis of the spool valve chamber 132 at right angles and that they are oriented to the third and fourth openings 135*c*, 135*d* formed in the side 131*b* of the sleeve 135, and therefore the depths of those openings 138, 139 become shallower than those of the openings of the prior art. Due to this, an increase in the opening areas of the openings 138, 139 in the side 131*b* of the spool valve body is restrained which would otherwise result from formation of holes as cast, and therefore an increase in the size of corresponding portions of the connecting member 121 is also restrained accordingly which is attached to the side 131*b* of the spool valve body. This will be described below. Reference numeral 40 denotes a seal.

The connecting member 121 is mounted on the side 131*b* of the spool valve body by making use of a mounting hole 131*c*. The relief opening 138 is made to communicate via a passage formed in the connecting member 121 with the oil pass pipes 122*r*, 122*l* which are connected to lubricating oil supply passages 141 (refer to FIG. 10) via passages formed in connecting members 124*r*, 124*l*. Similarly, the working hydraulic pressure supply opening 139 is made to communicate via another passage formed in the connecting member 121 with the oil pass pipes 123*r*, 123*l* which are connected to working hydraulic pressure supply passages 141 (refer to FIG. 10) communicating with variable valve timing switching mechanisms 109 via the other passages formed in the connecting members 124*r*, 124*l*.

As shown in FIGS. 6 and 7, the side 131*b* of the spool valve body 131 is selected as a side where the connecting member 21 is to be mounted which is a side (rear side) of the valve body opposite to the side where the intake manifold 105 is disposed. In addition, since the aforesaid respective oil pass pipes 122*r*, 122*l*, 123*r*, 123*l* are mounted on the connecting member 121 such that their axes become parallel with the axis of the side 131*b* of the spool valve body and substantially horizontal, there is no risk of these oil pass pipes 122*r*, 122*l*, 123*r*, 123*l* interfering with the intake manifold 105, whereby the intake manifold 105 can be installed between the V-shaped banks of cylinders in a compact fashion.

Figure 10:
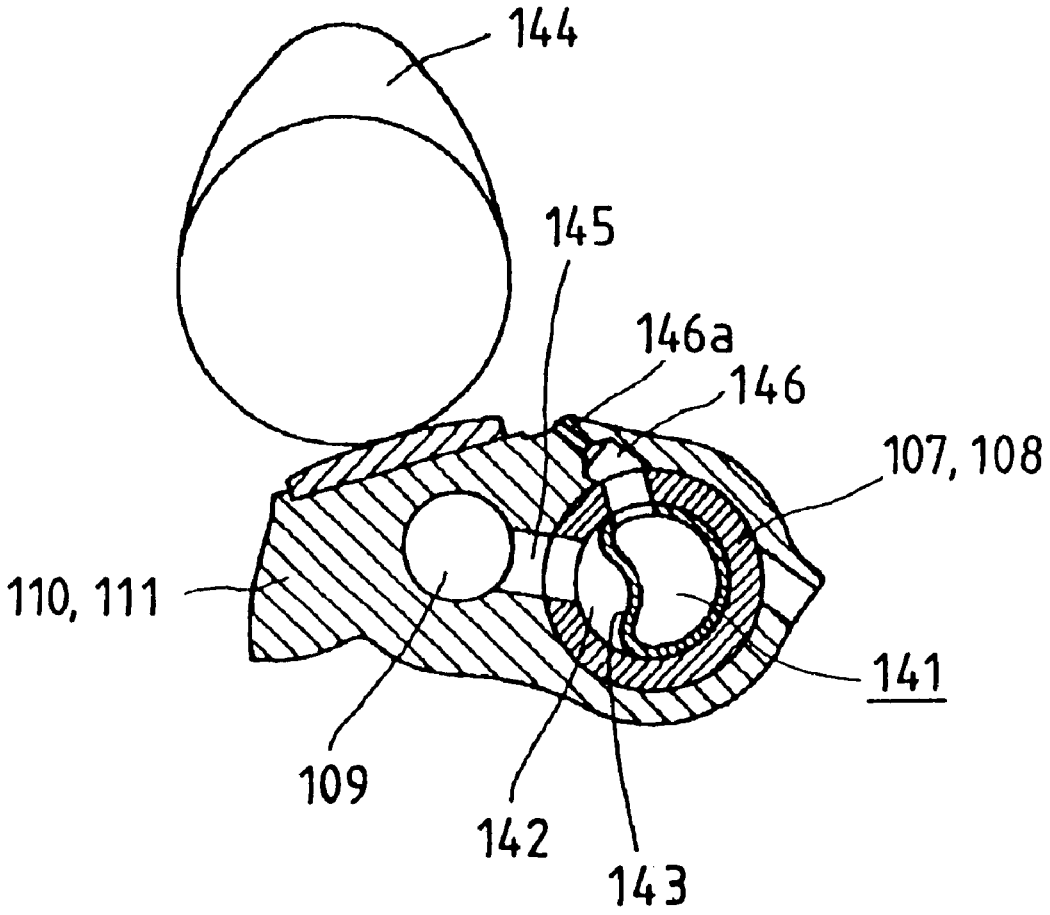
FIG. 10 is a schematic diagram showing partially a driven cam and a rocker arm of a valve system having a variable valve timing switching mechanism.
Figure 11B:
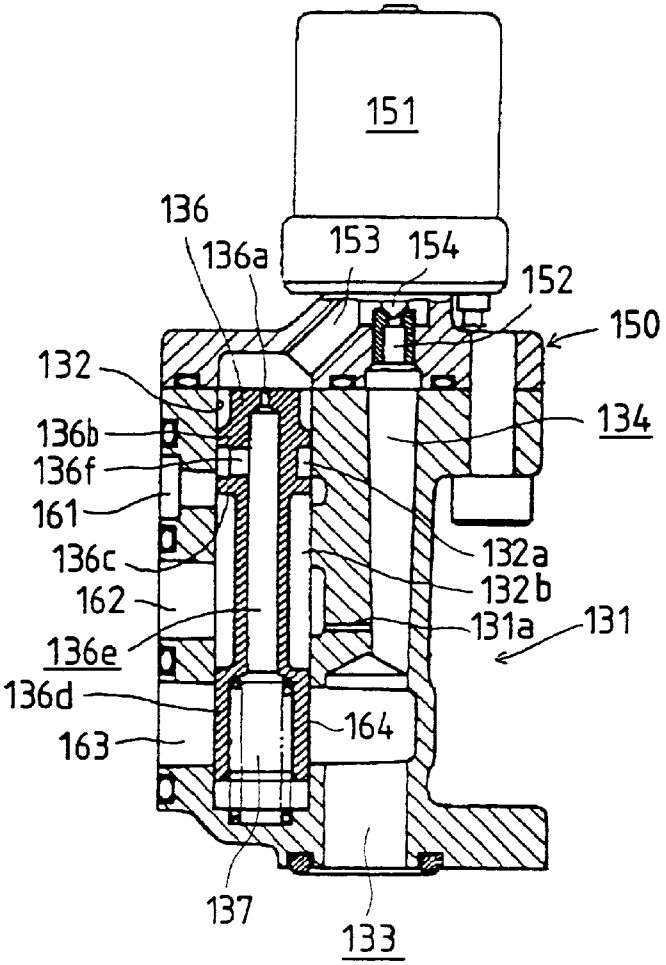
FIG. 11B is a vertical sectional-view of the same.
Figure 11A:
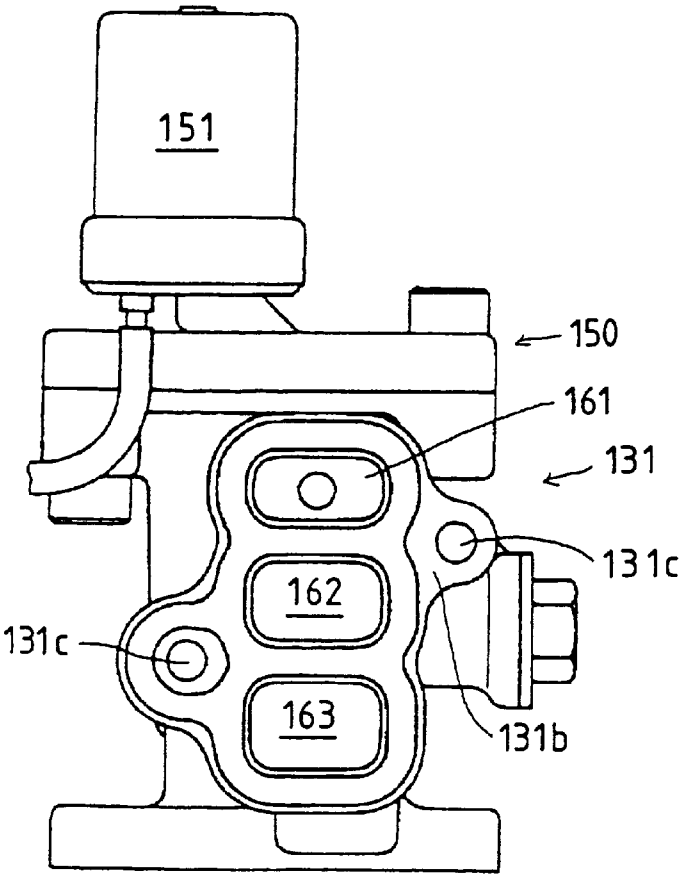
FIG. 11A is a front view of a prior art spool valve body.

As shown in FIG. 10, the lubricating oil supply passages 141 and the working hydraulic pressure supply passages 142 are formed in the intake rocker arm shafts 107 and exhaust rocker arm shafts 108 by partitioning a hollow portion of the respective shafts with a tubular member 143. The variable valve timing switching mechanisms 109 provided on the intake rocker arms 110 and exhaust rocker arms 111 are constructed so as to effect a connection of a plurality of rocker arms to each other and a release of such a connection by means of switching pins movable by virtue of hydraulic pressures. To be specific, a high or low hydraulic pressure is supplied to this mechanism 109 via a communication bore 45 communicating with the working hydraulic pressure supply passage 142, whereby the variable valve timing switching mechanism 109 can effect a connection of the rocker arms or a release of such a connection. On the other hand, an oil supply bore 46 is formed in the lubricating oil supply passage 141 which bore has an injection port 146*a* for supplying oil toward an abutment portion between the driven cam 144 and the rocker arms 110, 111.

In making use of relief oil from the relief opening 138 for lubrication of required portions through provision of the lubricating oil supply passages 141, in order to secure an amount of oil required for a needed lubrication, degrees of restriction of the first and second orifices 131*a*, 136*a* are suitably set. However, the degree of restriction of the second orifice 136*a* is reduced in order to increase the volume of oil passing therethrough, the response of the spool valve 136 is reduced if the volume of oil supplied to the outlet passage 153 is low. If such happens, the degree of restriction of the second orifice 136*a* is determined such that a good response of the spool valve 136 can be provided, while a third orifice 135*e* is formed which extends for communication from the second annular chamber 132*b* through the sleeve 135 into the relief opening 138, so that a shortage of lubricating oil resulting from a supply only from the second orifice 136*a* can be compensated by a supply from the third orifice 135*e*.

Figure 9B:
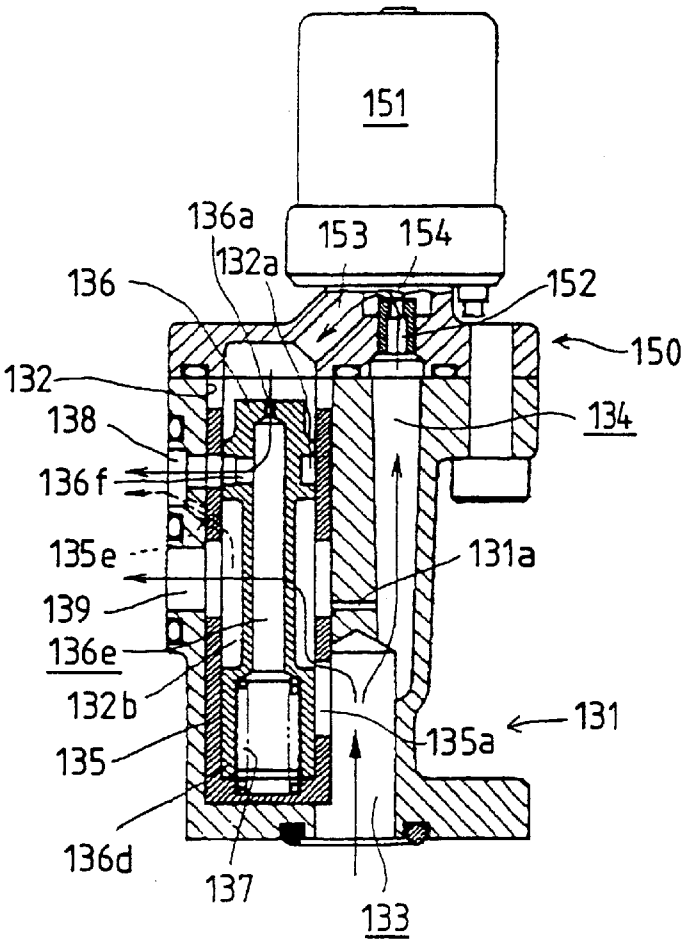
FIG. 9B shows a case where a high hydraulic pressure is supplied.
Figure 9A:
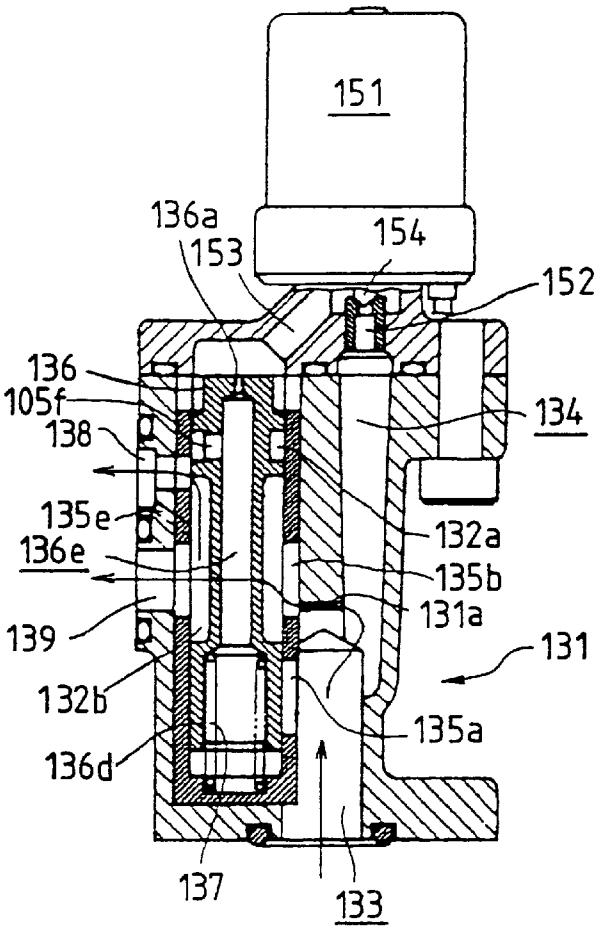

Next, referring to FIG. 9, an operation of the spool valve 136 constructed according to the mode of operation of the invention of the present patent application and a flow of oil through the spool valve 136 will be described below.

Oil is supplied to the oil introduction passage 133 and controlling hydraulic pressure supply passage 134 via the oil gallery 102*d* and the oil supply passage 102*c* formed in the cylinder block 102. As shown in FIG. 9-A, with the electromagnetic valve 151 being de-excited and the inlet passage 152 being closed by the valve body 154, the spool valve 136 is located at an upper position by virtue of the biassing force of the spring 137. Due to this, the communication passage 135*a* is closed by the lower land 136*d*, and the oil introduction passage 133 is caused to communicate with the second annular chamber 132*b* via the controlling hydraulic pressure supply passage 134 and the first orifice 131*a*. On the other hand, the working hydraulic pressure supply opening 139 is caused to communicate with the second annular chamber 132*b*, the relief opening 138 is caused to communicate with the outlet passage 153 via the first annular chamber 132*a*, the communication path 136*f*, the hole 136*e* and the second orifice 136*a*, and is also caused to communicate with the working hydraulic pressure supply opening 139 via the second annular chamber.

In this state, oil under a high hydraulic pressure in the working hydraulic pressure supply passages 142 is relieved, and oil under a high hydraulic pressure in the outlet passage 153 is also relieved through the second orifice 136*a*. Then, oil thus relieved is supplied from the relief opening 138 to the lubricating oil supply passages 141 through the connecting member 121, the oil pass pipes 122*r*, 122*l* and the connecting members 124*r*, 124*l*, and then oil so supplied is supplied to the abutment portions between the driven cams 144 and rocker arms 110, 111 from the injection ports 146*a* of the oil supply bores 146 for lubrication. Oil supplied from the first orifice 131*a* is supplied to the variable valve timing switching mechanisms 109 as a low hydraulic pressure from the working hydraulic pressure supply opening 139 via the connecting member 121, the oil pass pipes 123*r*, 123*l*, the connecting members 124*r*, 124*l*, the working hydraulic pressure supply passages 142 and the communication bores 145, whereby the variable valve timing switching mechanisms 109 are maintained in a non-operational state. Furthermore, a part of oil from the first orifice 131a is supplied to the lubricating oil supply passages 141 from the relief opening 138 through the connecting member 121, the oil pass pipes 122*r*, 122*l* and the connecting members 124*r*, 124*l*, and it is then supplied to the abutment portions between the driven cams 144 and the rocker arms 110, 111 from the injection ports 146*a*.

Next, with the electromagnetic valve 151 being excited and the valve body 154 being separated from the valve seat so as to open the inlet passage 152, since the oil introduction passage 133 is caused to communicate with the outlet passage 153 via the controlling hydraulic pressure passage 134 and the inlet passage 152, the spool valve 136 is moved to a lower position against the biassing force of the spring 137 by virtue of a high hydraulic pressure from the oil introduction passage 133 applied to the upper surface of the spool valve 136. Due to this, the lower land 102*d* is moved downwardly so as to open the communication passage 135*a*, whereby the oil introduction passage 133 is caused to communicate with the second annular chamber 132*b* via the communication passage 135*a*, while it is also caused to communicate with the first annular chamber 132*a* via the outlet passage 153, the second orifice 136*a*, the hole 136*e* and the communication path 136*f*.

In this state, a high hydraulic pressure is supplied to the working hydraulic pressure supply opening 139 via the communication passage 135*a*, and this high hydraulic pressure is then supplied to the variable valve timing switching mechanisms 109 via the working hydraulic pressure supply passages 142 for actuation thereof. On the other hand, a part of oil from the outlet passage 153 is supplied to the relief opening 138 via the second orifice 136*a,* the hole 136*e,* the communication path 136*f* and the first annular chamber 132*a*. Then, this oil is supplied to the lubricating oil supply passages 141, and then it continues to be supplied to the abutment portions between the driven cams 144 and the rocker arms 110, 111 from the injection ports 146*a* of the oil supply bores 146 for lubrication thereof. Furthermore, in a case where the third orifice 135*e* is formed, a part of the high hydraulic pressure flowing into the second annular chamber 132*b* is supplied to the relief opening 138 through the third orifice 135*e* and is then supplied together with oil from the outlet passage 153 to the abutment portions between the driven cams 144 and the rocker arms 110, 111 from the injection ports 146*a* via the lubricating oil supply passages 141.

Since the mode of operation of the present invention is constructed as described heretofore, the following advantages are provided.

Since the oil introduction passage 133 is formed such that it partially overlaps the spool valve chamber 132 when viewed from the axial direction of the same chamber 132, the distance between the axes of the spool valve chamber 132 and the oil introduction passage 133 can be made shorter than that of the prior art, thereby making it possible to miniaturize the spool valve body 131. Furthermore, since the mounting seat 102*b* for the spool valve body 131 can be made small to the extent that the spool valve body is miniaturized, not only can the spool valve body 131 itself be miniaturized, but also the intake manifold 105 can be disposed within a limited space between the V-shaped banks of cylinders.

In addition, since the communication passage 135*a* is formed in the sleeve 135, there is no need to form in the spool valve body 131 itself a hole, for instance, a hole as cast, for forming a communication passage therein. Furthermore, there is no need to provide a plug for closing such a hole. Therefore, the spool valve body can be miniaturized and the man-hours can also be reduced accordingly.

The relief opening 138 and the working hydraulic pressure supply opening 139 are formed in the side 131*b* of the spool valve body 131 which is a plane parallel with the axis of the spool valve chamber 132 such that the axes of the same openings intersect with the axis of the spool valve chamber 132 at right angles and that the openings are formed in such a manner as to be oriented to the openings formed in the side 131*b* of the sleeve, and therefore the depths of the relief opening 138 and the working hydraulic pressure supply opening 139 can be made shallower than those of the prior art. Thus, the increase in the opening areas of those openings 138, 139 formed in the side 131*b* of the spool valve body can be restrained which result from the gradient of the holes as cast, whereby the increase in the size of the corresponding portions of the connecting member 121 can also be restrained. As a result of this, the overall size of the device constituting the oil passage system can be smaller than that of the prior art example, and moreover, not only can the size of the spool valve body 131 itself be reduced but also the sealing area where the connecting member 121 is attached can be reduced.

The connecting member 121 is mounted on the side 131*b* (rear side) of the spool valve body 131 which is opposite to the side where the intake manifold 105 is disposed, and the oil pass pipes 122*r,* 122*l,* 123*r,* 123*l* attached to the connecting member 121 are attached thereto such that the axes thereof become parallel with the side 131*b* of the spool valve body 131 and substantially horizontally, and therefore there is no risk of these pipes interfering with the intake manifold 105, whereby the intake manifold 105 can be disposed between the V-shaped banks of cylinders in a compact fashion.

The relief passage is provided for each variable valve timing switching mechanism 109 with no exception, and relief oil discharged from the relief passage is constructed to be supplied to the abutment portion between the driven cam 144 and the rocker arm 110, 111 which is a portion needing lubrication. Thus, this construction allows oil which is conventionally discharged from the relief passage and returned to the oil pan to be used for lubrication of the abutment portion needing lubrication between the driven cam 144 and the rocker arm 110, 111 of the valve system. Furthermore, since the lubricating oil supply passage 141 is formed in the rocker arm shaft 141, there is no need to separately form a lubricating oil supply passage 141 using a tube, thereby making it possible to integrate the piping in a compact fashion.

In the mode of operation described above, relief oil introduced into the lubricating oil supply passage 141 is supplied to the abutment portion between the driven cam 144 and the rocker arm 110, 111 which is a lubrication needing portion of the valve system. However, the lubrication needing portion may be any other portion needing lubrication such as camshaft supporting portion 112, 113 of the driven cam 144, the hydraulic tappet 114 and a bearing portion.

While there has been described in connection with the preferred embodiment of the invention, it will be obvious to those skilled in the art that various changes and modifications may be made therein without departing from the invention, and it is aimed, therefore, to cover in the appended claim all such changes and modifications as fall within the true spirit and scope of the invention.

What is claimed is:

1. A V-shaped internal combustion engine comprising:

a crankshaft;

a cylinder block including a plurality of cylinders which are banked about said crankshaft into a V-shape so as to from V-shaped banks relative to each other;

an intake manifold disposed between said V-shaped banks of said cylinders; and a hydraulic pressure control valve, disposed at one end of said cylinder block in an axial direction of said crankshaft and also disposed between said V-shaped banks of cylinders, for controlling hydraulic pressures which are supplied to a hydraulic pressure control device, wherein said hydraulic pressure control valve is disposed at said one end of said cylinder block in the axial direction of said crankshaft which is opposite to the other end where a timing mechanism is provided, said hydraulic pressure control valve is disposed at a position closer to said other end of said cylinder block than said intake manifold in the axial direction of the crankshaft, and wherein said hydraulic pressure control valve is directly attached to said cylinder block.

2. A V-shaped internal combustion engine comprising:

a crankshaft;

a cylinder block including a plurality of cylinders which are banked about said crankshaft into a V-shape so as to from V-shaped banks relative to each other;

an intake manifold disposed between said V-shaped banks of said cylinders;

a hydraulic pressure control valve, disposed at a first end of said cylinder block in an axial direction of said crankshaft and also disposed between said V-shaped banks of cylinders, for controlling hydraulic pressures which are supplied to a hydraulic pressure control device;

an oil introduction passage;

a spool valve chamber substantially extending in parallel with said oil introduction passage;

a sleeve accommodated in said spool valve chamber; and a spool valve slidably disposed within said sleeve, wherein said sleeve has a communication passage capable of communicating said oil introduction passage and said spool valve chamber, and said spool valve chamber and said oil introduction passage are located so as to partially overlap each other when viewed in an axial direction of said spool valve chamber.

3. The V-shaped internal combustion engine as set forth in claim 1, wherein said hydraulic pressure control valve is disposed at said first end of said cylinder block in the axial direction of said crankshaft which is opposite to a second end where a timing mechanism is provided.

4. The V-shaped internal combustion engine as set forth in claim 3, wherein said hydraulic pressure control valve is disposed at a position closer to said second end of said cylinder block than said intake manifold in the axial direction of the crankshaft.

5. The V-shaped internal combustion engine as set forth in claim 3, wherein said hydraulic pressure control valve comprises:

an oil introduction passage; and a spool valve chamber substantially extending in parallel with said oil introduction passage;

a sleeve accommodated in said spool valve chamber; and a spool valve slidably disposed within said sleeve, wherein said sleeve has a communication passage capable of communicating said oil introduction passage and said spool valve chamber, and said spool valve chamber and said oil introduction passage are located so as to partially overlap each other when viewed in an axial direction of said spool valve chamber.

6. The V-shaped internal combustion engine as set forth in claim 3, wherein said hydraulic pressure control device comprises a plurality of variable valve timing control devices which are respectively disposed on cylinder head portions of said V-shaped banks, wherein each of said cylinder head portions of said V-shaped banks is provided with an oil passage for supplying a hydraulic pressure to said respective variable valve timing control devices, and wherein oil pass pipes connected to said oil passages at third end thereof, respectively, extend to a central portion in a direction perpendicular to said axial direction of said crankshaft, to thereby be connected to said hydraulic pressure control valve at a fourth end thereof.

7. The V-shaped internal combustion engine as set forth in claim 6, wherein said hydraulic pressure control valve is disposed at a position closer to said second end of said cylinder block than said intake manifold in the axial direction of the crankshaft.

8. The V-shaped internal combustion engine as set forth in claim 6, wherein said hydraulic pressure control valve comprises:

an oil introduction passage; and a spool valve chamber substantially extending in parallel with said oil introduction passage;

a sleeve accommodated in said spool valve chamber; and a spool valve slidably disposed within said sleeve, wherein said sleeve has a communication passage capable of communicating said oil introduction passage and said spool valve chamber, and said spool valve chamber and said oil introduction passage are located so as to partially overlap each other when viewed in an axial direction of said spool valve chamber.

9. The V-shaped internal combustion engine as set forth in claim 6, wherein said hydraulic pressure control valve is supported by said oil pass pipes.

10. The V-shaped internal combustion engine as set forth in claim 6, wherein said oil pass pipes are mounted on a first side of said hydraulic pressure control valve which is opposite to a second side facing with said intake manifold.

11. The V-shaped internal combustion engine as set forth in claim 6, further comprising a lubricating oil passage extended in parallel with said oil passage for supplying lubricating oil to valve system components.

12. The V-shaped internal combustion engine according to claim 11, wherein said hydraulic pressure control valve is formed to project upwardly from said cylinder block.

* * * * *